US005765643A

United States Patent [19]

Shaaban et al.

[11] Patent Number: 5,765,643

[45] Date of Patent: Jun. 16, 1998

[54] METHOD AND APPARATUS FOR INJECTION OF TUBING INTO WELLS

[75] Inventors: Khaled Shaaban; Wally S. McClanahan; James Bodhaine, all of Houston, Tex.

[73] Assignee: Vita International, Inc., Houston, Tex.

[21] Appl. No.: 643,372

[22] Filed: May 6, 1996

[51] Int. Cl.[6] ..... E21B 19/22

[52] U.S. Cl. ..... 166/384; 166/77.2

[58] Field of Search ..... 166/384, 385, 166/77.2

[56] References Cited

U.S. PATENT DOCUMENTS

| | | | |
|---|---|---|---|
| 2,345,816 | 4/1944 | Hays | 255/1.6 |
| 3,116,781 | 1/1964 | Rugeley et al. | 153/54 |
| 3,116,793 | 1/1964 | McStravick | 166/77 |
| 3,291,256 | 12/1966 | Eitel | 182/129 |
| 3,559,905 | 2/1971 | Palynchuk | 242/54 |
| 3,690,136 | 9/1972 | Slator et al. | 166/77 X |
| 3,722,775 | 3/1973 | Sarracino et al. | 226/100 |
| 3,762,725 | 10/1973 | Taylor | 277/32 |
| 3,777,964 | 12/1973 | Kruner et al. | 226/183 |
| 3,794,233 | 2/1974 | Dykmans | 226/183 |
| 3,872,680 | 3/1975 | Nicholson et al. | 61/72.3 |
| 3,902,612 | 9/1975 | Hall | 214/77 |
| 4,003,435 | 1/1977 | Cullen et al. | 166/315 |
| 4,009,754 | 3/1977 | Cullen et al. | 166/77 |
| 4,066,093 | 1/1978 | Egerstrom | 137/355.2 |
| 4,103,841 | 8/1978 | Flynn et al. | 242/86.2 |
| 4,145,014 | 3/1979 | Chatard et al. | 242/83 |
| 4,553,590 | 11/1985 | Phillips | 166/53 |
| 4,673,035 | 6/1987 | Gipson | 166/77.2 |
| 4,743,175 | 5/1988 | Gilmore | 166/77.2 X |

OTHER PUBLICATIONS

Otis Engineering Corp., advertising, 46 Drilling: The Wellsite Publication 2–3 (Feb., 1985).

*Primary Examiner*—William P. Neuder
*Attorney, Agent, or Firm*—Wendy K. Buskop; Chamberlain, Hrdlicka et al.

[57] ABSTRACT

Apparatus for injecting tubing into a well having a tubing storage means and an injector device with a means for applying variable pressure to the coil tubing. The injector device is designed to accommodate tubing with couplings and other downhole tools without damaging the tubing. Also provided is a method of injecting and retrieving a length of coil tubing having couplings and other downhole tools that is tubing friendly.

15 Claims, 4 Drawing Sheets

METHOD AND APPARATUS FOR INJECTION OF TUBING INTO WELLS

BACKGROUND

The present invention relates to a coil tubing injector. More particularly, the present invention relates to a coil tubing injector with means for injecting tubing having a variable pressure means exerting pressure on the coil tubing as the tubing is injected into or removed from the well.

Continuous tubing is often used to aid in completion, servicing or production of a well. Often, after the well has been drilled, or even during the drilling process, it is desired to pass a separate tube down the bore hole for passing gasses and fluids down into the hole for a particular purpose. For example, the tubing can be used for the circulation of nitrogen, oil, water, acid, alcohol, chemicals or solvents, for downhole workovers, location of hydrate plugs, placing of cement plugs through packers, and for circulating cement to casing bottoms, among other functions. The placement of the tube in the hole is accomplished by means of a device called an "injector", so-called because the tubing must be forced into the hole until enough of the tubing has been injected that the weight of the tubing inserted into the hole is sufficient to overcome various forces acting against movement of the tubing such as pressure in the wellbore and resistance imposed by the tubing straightener.

Normally, the tubing used is a continuous length of tubing without couplings. The use of tubing without couplings decreases the likelihood of rupture of the tubing when injecting gases and fluids into the well hole at extremely high pressures. Also, injection of continuous tubing into the well bore at a steady rate is normally faster than assembling tubing joint by joint for lowering into the hole. Thus, continuous tubing can help save time and drilling costs.

In order to handle and store the continuous tubing, the tubing must be capable of being wound onto a reel or otherwise coiled. If the tubing material is made of PVC pipe or other high-strength plastic, coiling of the tubing for storage poses no significant problems, because the plastic tends to straighten itself when uncoiled for injection into a well bore. However, under certain downhole conditions, more durable materials are required for the tubing. For example, PVC pipe is able to withstand only relatively low pressures. Further, high-strength, low-alloy steel is often used in "sour" environments, i.e., environments in which large amounts of acid or sulfur gases are present. The use of continuous steel pipe which must be stored by coiled poses significant problems because, when uncoiled, the steel pipe tends to retain the curvature imparted to it during storage.

In some instances tubing with couplings is highly desirable. Continuous lengths of tubing can be cost prohibitive as well as presenting transport and loading problems. Linking two sections of coiled tubing allows for longer pieces of tubing to be used in one application. Couplings may also be used to attach monitoring devices such as logging tools, gas valves, and other downhole tools. Attaching couplings allows for replacement of tubing sections that may be damaged or worm, thus extending the overall life of the tubing.

Known tubing injectors consist of a series of moving blocks driven by chains which grip the tubing on opposite sides, pulling it out of storage and injecting it into the well and straightening it at the same time. However, this type of apparatus for injecting and straightening the tubing often damages the surface of the tubing. Thus, there is a need for a coil tubing injector which both injects and straightens the tubing, but which does not damage the surface of the tubing, thereby extending the life of tubing such as the copper tubing described below, which is relatively expensive to replace. Such a device would be of particular utility for use with special purpose tubing, for example, copper tubing with fiberglass coating such as is used in some segments of the industry for heating thick oil in the well to facilitate production. In these situations, the fiberglass coating is easily damaged by known injecting and straightening devices.

Another imitation of known tubing injectors is the expense of maintaining them. Many of the parts wear quickly and are expensive to replace and changing the worn parts can be very difficult. A tubing injector with parts that have a longer life and are quickly and easily changed would save time and money for the operator.

By their nature coil tubing injectors have certain parts that are subjected to extreme amounts of pressure and stress. In the reel design, the tubing is held in place and straightened by exerting pressure on the tubing so that there is enough friction to hold the tubing and straighten it as it is injected into the well. Several combinations of rubber and steel surrounding the tubing have been used to achieve this result. Rubber wears out quickly and does not hold the tubing if it gets oily. Steel grooves likewise do not have enough friction to hold the tubing if they get oily and they tend to flatten the tubing if too much pressure is exerted on the tubing. Steel is also more expensive and weighs more than other polymers. A tubing injector with gripping devices that are durable yet flexible and can withstand high amounts of pressure and stress would be highly desirable.

Another consideration is having a tubing injector which operates independently of the equipment on the well. The recent advancement in other areas of oil and gas production in which the tubing injector is used to operate other downhole equipment or as a medium for performing various production tests and remedial operations. When used in this manner, it is desirable that this additional equipment be placed below the injecting and straightening means.

Another problem with known tubing injectors is the resistance they provide to couplings and other attachments. If the tubing has any type of coupling device or attachment that increases the outer diameter of the tubing the injector may cause damage to the protrusion reducing the integrity of the tubing.

A durable and flexible material that can be used in place of the gripping devices described previously is polyamide. Polyamide is eighty percent lighter than steel and has a modulus of elasticity that is ninety-eight percent lower than steel. This means that the gripping device will conform to deformations caused by changes in the outer diameter of the tubing thus increasing the surface contact between the gripping device and the tubing. The surface contact is increased by almost 400% relative to steel. The increased surface contact allows for greater control over the tubing, reducing transverse movement of the tubing. These characteristics allow for longer tubing life because the tubing is less likely to be damaged by the gripping device.

Polyamide is less expensive and has a longer life than steel. Polyamide components are approximately one-third the cost of comparable steel components. Polyamide is easier and quicker to machine thus reducing labor costs. Polyamide materials are more resistant to corrosion from water and maintain a coefficient of friction of 0.03 or greater when wet.

Polyamide is superior to rubber parts used in gripping devices. Polyamide is more resistant to abrasion than rubber and does not deteriorate as quickly as rubber. Polyamide is not effected by oil or other chemicals in an oil field. Rubber deteriorates when contacted with oil or other chemicals present in the field and the coefficient of friction is reduced when rubber is wet causing the tubing to slip. The coefficient of friction for polyamide increases when it gets wet, thus eliminating the problem of slippage present with the rubber. Polyamide also can withstand higher temperatures than rubber while remaining functional.

It is an object of the present invention to provide a tubing injector comprising a base with a frame slidably mounted thereon, a tubing storage means being mounted on the base and having coil tubing stored thereon, an injector device mounted on the frame, means for rotating the injector device, means mounted around a portion of the perimeter of the injector device for exerting pressure against the coil tubing when the coil tubing is directed between the circumference of the injector device and said pressure exerting means, means for straightening the tubing.

It is another object of the present invention to provide a tubing injector unit which does not damage the exterior of the coil tubing an allows couplings and other attachments to pass without being damaged.

A further object of the present invention is to provide a tubing injector unit which stores the tubing evenly on a storage reel by traversing the reel as the tubing is withdrawn from the well.

These and other objects of the present invention will be evident to those skilled in the art from the following detailed description of the preferred embodiment.

SUMMARY OF THE INVENTION

In one embodiment of the invention, there is provided a tubing injector comprising a base and an injector device mounted on the base. The injector device has a longitudinal axis and a perimeter and is rotatable mounted on a frame. A plurality of guide means to guide the tubing along the perimeter of the injector device are mounted on the injector device via a mounting means so that the plurality of guide means are movable radially with respect to the longitudinal axis of the injector device from a first position to a second position. A biasing means biases the plurality of guide means toward the first position were the biasing means is connected to the mounting means. There is a tubing storage means mounted on the base with tubing stored thereon. There is a means for rotating said injector device connected to the frame and a means for straightening the coil tubing as it is injected into or retracted from the well.

There is also provided a method for injecting and retrieving a length of tubing. The method comprises utilizing an injector device which can exert pressures of up to 5000 pounds per square inch on coil tubing. This is done by engaging a section of tubing with the injector device. The injector device has a plurality of guide means disposed thereon for guiding the tubing into the well There is a means for receiving coil tubing on the injector device. A mounting means connects the injector device to the guide means so that the guide means is movable radially with respect to the injector device from a first position to a second position. A biasing means biases the guide means toward the first position.

The method is carried out by adjusting the biasing means to accommodate a section of tubing that has protrusions increasing the outer diameter of the tubing, while maintaining a constant force on the tubing normal to the injector device. A varying amounts of pressure are exerted on the tubing through at least one of the plurality of guide means in a controlled manner normal to the tubing to engage the tubing. The tubing is then routed by turning the injector device at the desired pressure and speed to transfer the coil tubing to the desired location. This method can be employed with all types tubing such as copper and composite tubing that is frequently damaged by current state-of-the-art designs.

DESCRIPTION OF THE PREFERRED EMBODIMENT

Figure 1:
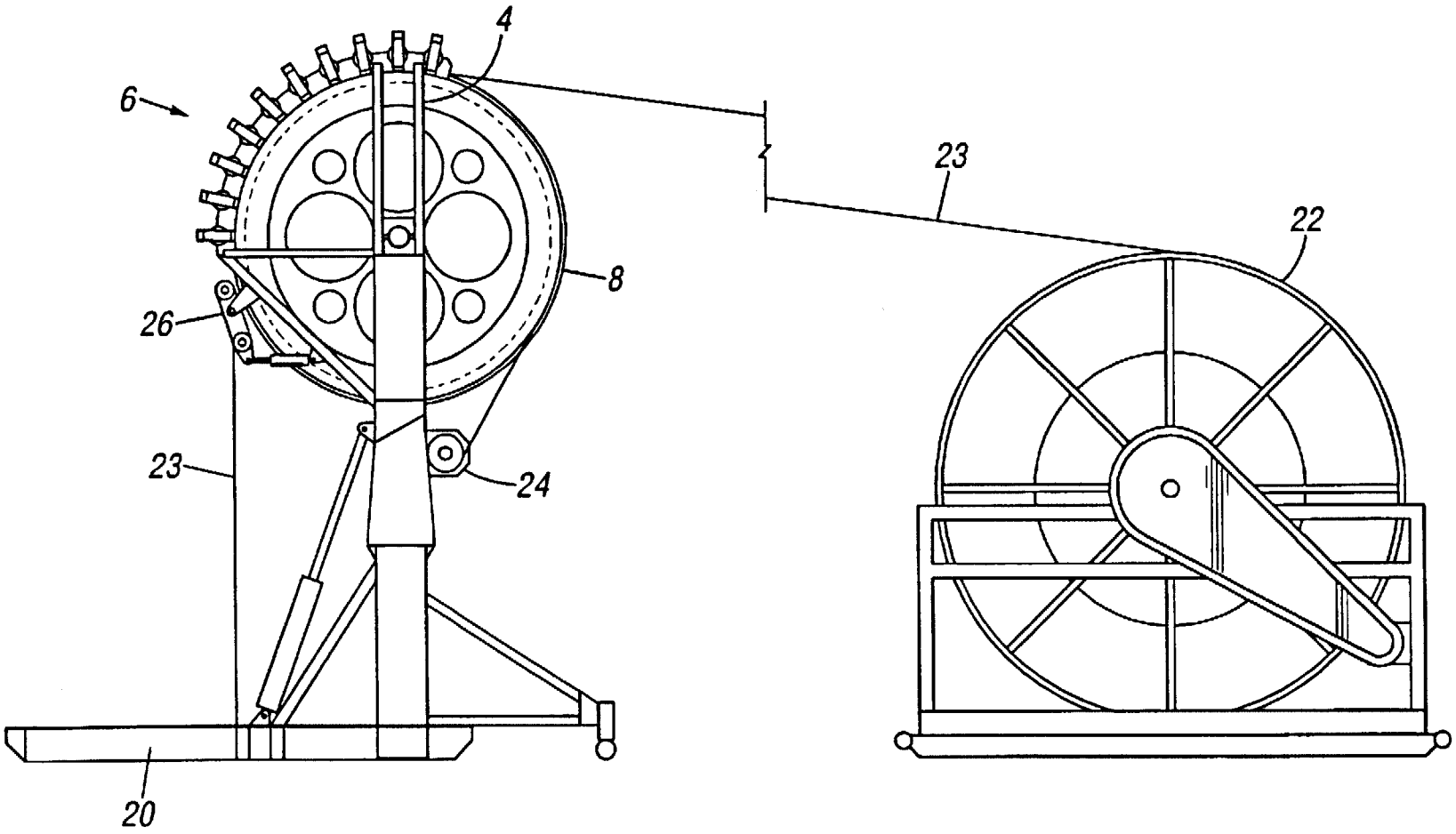
FIG. 1 is a side view of the tubing injector.
Figure 2:
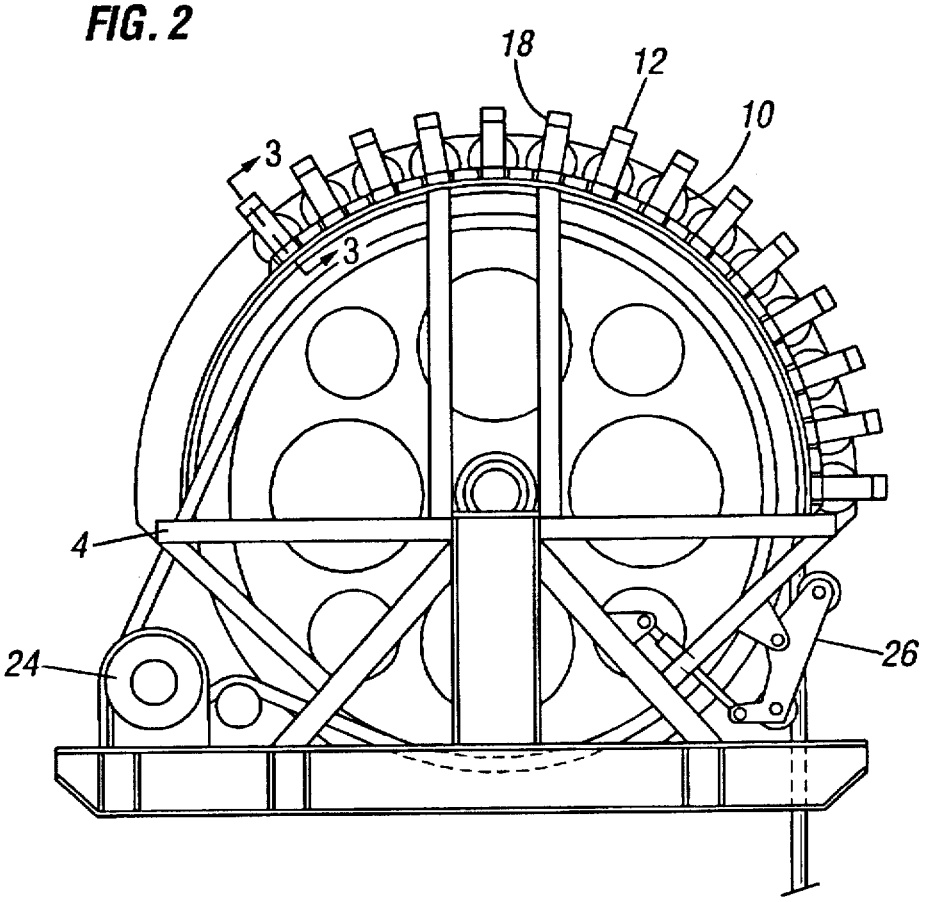
FIG. 2 is an side view of the injection device.

As shown in FIG. 1, one embodiment of the invention provides for a tubing injector 2 comprising a base 20 and an injector device 6 mounted on the base 20. The base 20 can be a free standing as shown or mounted to any other stable surface such as a trailer, a truck or a platform. The injector device 6 has a longitudinal axis and a perimeter 8 and is rotatably mounted on a frame 4. A plurality of guide means 10 to guide the tubing along the perimeter 8 of the injector device 6 are mounted on the injector device 6 via a mounting means 12 so that the plurality of guide means 10 are movable radially with respect to the longitudinal axis of the injector device 6 from a first position 14 to a second position 16. A biasing means 18 biases the plurality of guide means 10 toward the first position 14 were the biasing means 18 is connected to the mounting means 12. There is a tubing storage means 22 with coil tubing 23 stored thereon. The coil tubing 23 is fed from the tubing storage means 22 to the injector device 6. There is a means for rotating 24 said injector device 6 connected to the frame 4 and a means for straightening 26 the coil tubing as it is injected into or retracted from the well. The injector device 6 can be a reel as shown in FIG. 1 or a variety of other shapes.

Figure 3:
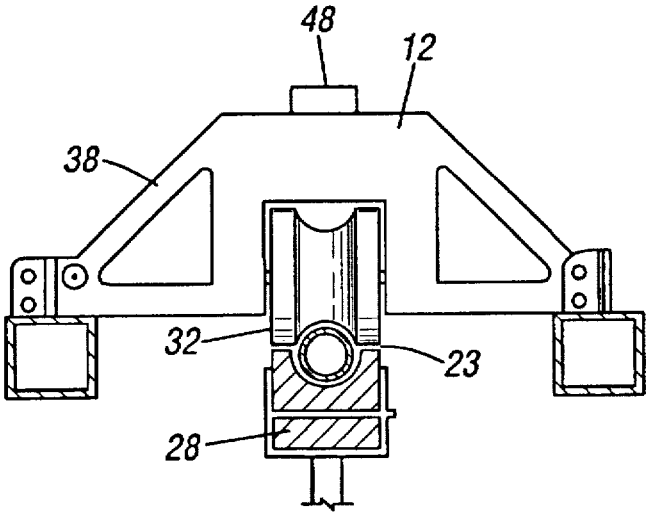
FIG. 3 is a cross-sectional view of cut lines 3—3.
Figure 3A:
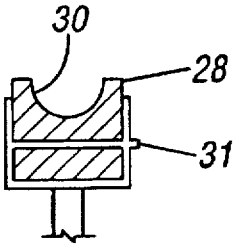
FIG. 3*a* is cross-sectional view of the means for receiving coil tubing.

In a preferred embodiment, the injector device 6, has a means for receiving coil tubing 28 forming a groove 30 positioned along the perimeter 8 of the injector device 6. The groove 30 can be U-shaped or V-shaped. The means for receiving coil tubing 28 is secured to the perimeter 8 of the injector device 6 with a pin 31 as shown in FIG. 3*a*. The means for receiving coil tubing 28 is positioned along the perimeter 8 of the injector device 6 in sections, each section being held in place by pins or bolts. This construction makes replacement of the means for receiving coil tubing 28 quick and easy. The coil tubing 23 is positioned between the plurality of guide means 10 and the groove 30 when the injector device 6 is in use. Each of the plurality of guide means 10 comprises a roller 32 having a longitudinal axis and a circumference. The circumference of the roller 32 forms a roller groove 36 for engagably receiving coil tubing 23.

The roller 32 and the means for receiving coil tubing 28 can made from the same or similar materials. Preferably, the roller 32 and means for receiving coil tubing 28 are made from a polymer compound that has the ability to withstand temperatures of 422 degrees Fahrenheit, a compressive strength of 13,920 pounds per square inch, a flexural strength of 11,000 pounds per square inch, and a flexural modulus of 350,000 pounds per square inch. The roller 32 and the means for receiving coil tubing 28 can be made from a member of the group comprising polypropylene, polyurethane, nylon, or mixtures thereof. In a preferred embodiment, the roller 32 and the means for receiving coil tubing 28 are made from a member of the group comprising polyamide or composites of polyamide. Polyamide may be obtained from Timco of Houston, Tex. When the roller and means for receiving coil tubing are made from the compounds listed above, they are compressible up to four percent. This degree of compressibility allows for the roller and the groove to conform to tubing that has couplings or other downhole tools attached to the tubing without damaging the tubing. The roller 32 and the means for receiving coil tubing 28 preferably have a coefficient of friction of equal to or greater than 0.03. The coefficient of fiction is preferably, in the range of from about 0.03 to about 0.045. Another advantage associated with using these materials is that more fragile tubing such as composite tubing or copper tubing can be used with very little damage to the tubing. The means for receiving coil tubing 28 can also be made of steel In another preferred embodiment, the mounting means 12 comprises a bracket 38 detachably mounted the perimeter of the injector device 6. The bracket 38 is attached to the injector device 6 by at least one quick release pin 44 for holding the detachably engaging bracket 38 to the injector device 6 and permitting quick release and pivoting of the mounting means 12 to up to 90 degrees. This allows for easy removal of the rollers 32. The bracket 38 can be secured to the injector device 6 with a ¾ inch bolt at a hinge point, three quick release pins for locking the guide means 10 in the closed position on the injector device 6 and one quick release pin point that enables the guide means 10 to be locked in the open position on the injector device 6. The roller 32 is capable of moving from a first position 14 to a second position 16 in response to changes in the circumference of the coil tubing 23.

Figure 4A:
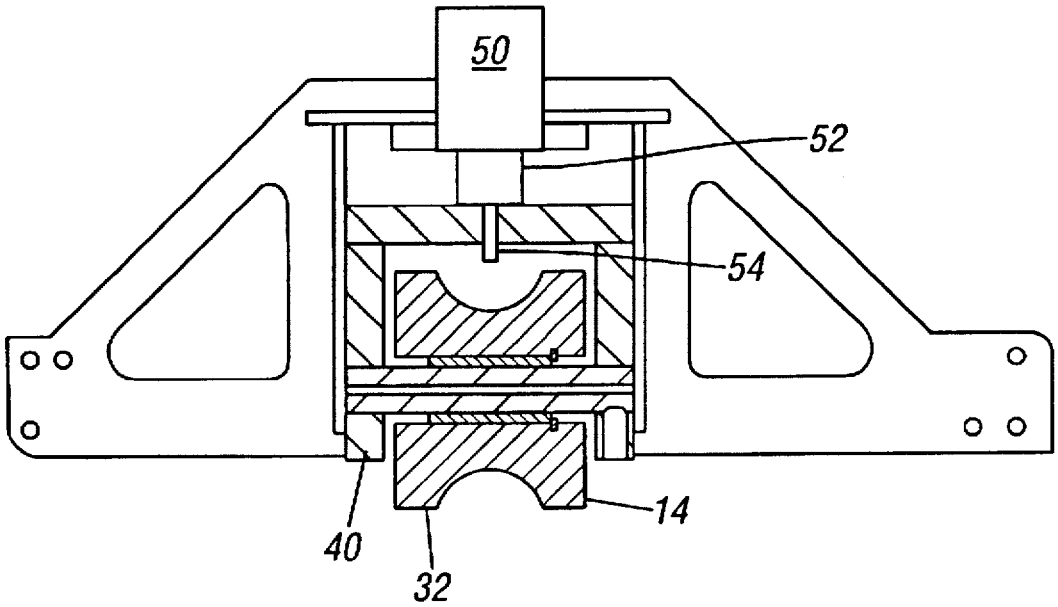
FIG. 4*a* is a cross-sectional view of the guide means and the mounting means where the guide means in a first position.
Figure 4B:
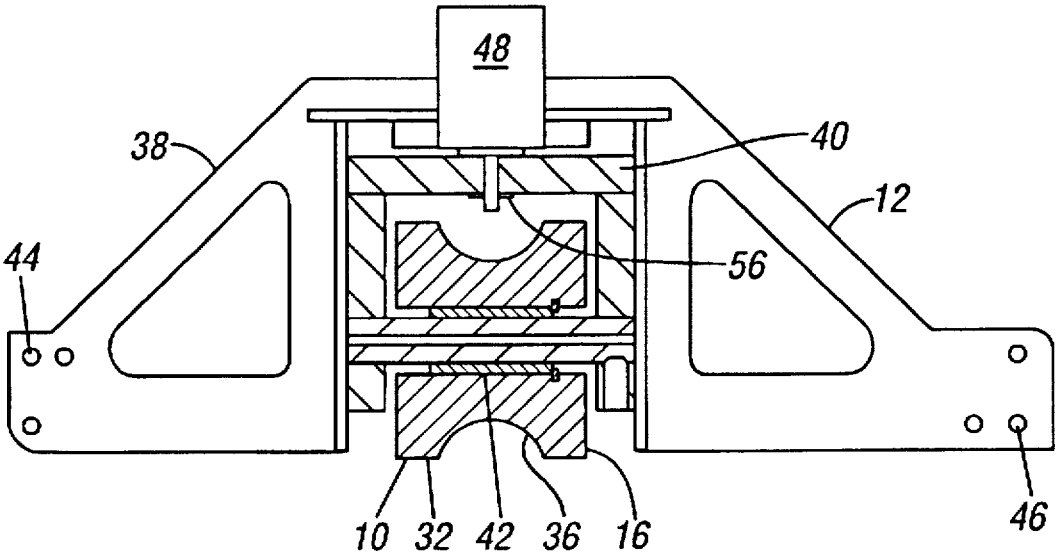
FIG. 4*b* is a cross-sectional view of the guide means and the mounting means where the guide means is in a second position.
Figure 5:
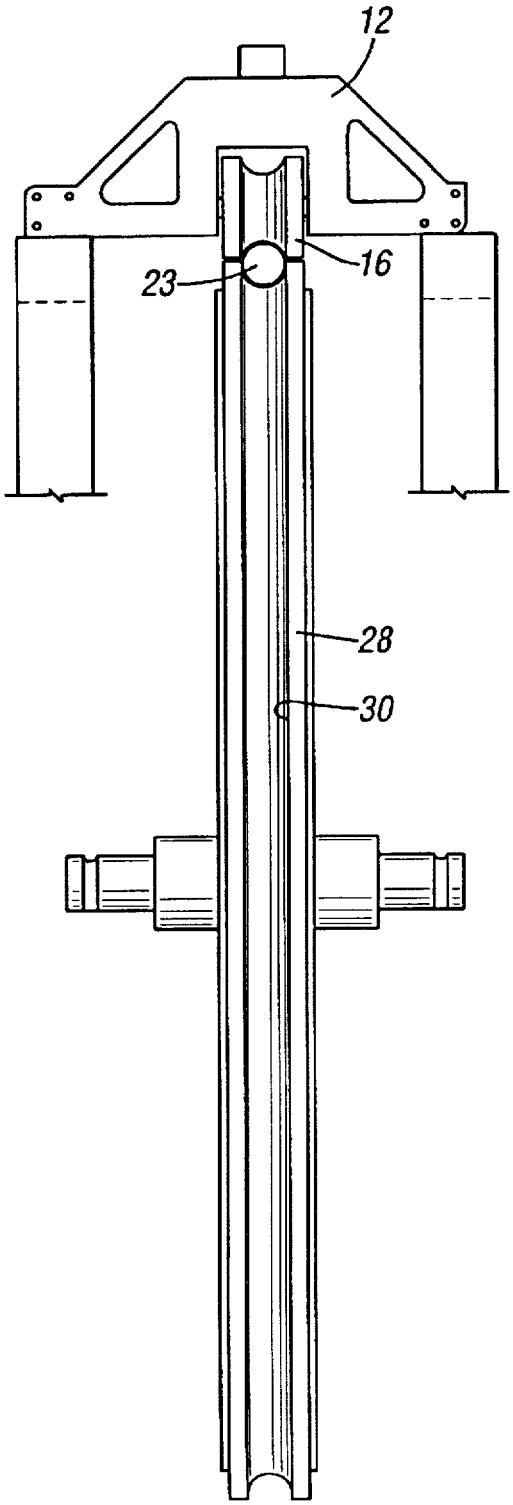
FIG. 5 is an end view of the injector device.
Figure 6:
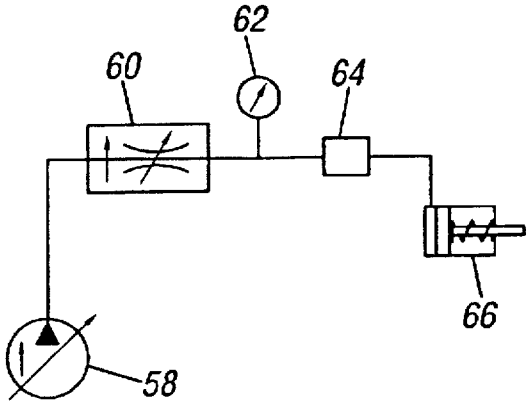
FIG. 6 is a schematic diagram of the hydraulic system of the actuator means.

Preferably, the plurality of guide means 10 are divided into groups with 4–10 guide means 10 in each group. The roller 32 has an outer diameter of 5 and ½ inches is capable of extending ¼ inch to a first position 14 and retracting ¾ inch to a second position 16. The bracket 38 has a clevis 40 mounted therein. A clevis is a generally U-shaped wire or other metal with a pin intersecting the ends of the U. The roller 32 is mounted on the bracket 38 via the clevis 40 with roller bearings 42 as shown in FIG. 4*a* and 4*b*.

Preferably, the biasing means 18 consists of an actuator means 48 for providing a controlled force normal to the coil tubing 23 and guide means 10. The coil tubing 23 is positively engaged between the groove 30 and the guide means 10 when the injector device 6 is being rotated to pull the coil tubing 23 off of the tubing storage means 22 or return the tubing to the tubing storage means 22. The actuator means 48 preferably comprises a means for remotely adjusting the pressure control adjuster which in turn adjusts the pressure exerted on the coil tubing 23. Preferably, the pressure on each roller can be adjusted individually or in groups of 4–10 rollers in each group. This allows the operator to change the pressure in response to changes in the tubing or to aid in injecting the tubing into the well The actuator means 48 can be a remotely operated hydraulic actuator. The hydraulic actuator preferably has ¾ inch×2 inch stroke single acting cylinder 50 spring return, with the cylinder 50 mounted on the top of the bracket 38 and an adaptor plug 52 disposed at the end of the shaft 54 mounted through the clevis 40 and the clevis 40 being secured with a locking ring 56. The actuator means 48 can comprise a pressure control adjustor 64; a pressure transmitter 58 connected to the adjustor; a logic circuit 60 for directing the pressure control adjuster; and a pressure sensing means 62 connected to the logic circuit 60 so that pressure on the coil tubing 23 can be adjusted and readjusted in order to provide a constant force against the coil tubing 23 via the guide means 10. The pressure transmitter 58 can be a variable displacement pressure compensating pump, an air compressor, or an electric switching mechanism.

In another embodiment, there is provided, a method for injecting and retrieving a length of coil tubing. The method comprises utilizing an injector device 6 which can exert pressures of up to 5000 pounds per square inch on coil tubing. This is done by engaging a section of coil tubing 23 with the injector device 6. The injector device 6 has a plurality of guide means 10 disposed thereon; a means for receiving coil tubing 28; a mounting means 12 connecting the injector device 6 to the guide means 10 as described previously. The biasing means 18 is adjusted to accommodate a section of coil tubing that has protrusions increasing the outer diameter of the coil tubing, while maintaining a constant force on the coil tubing normal to the injector device 6. Varying amounts of pressure are exerted on the coil tubing through at least one of the plurality of guide means 10 in a controlled manner normal to the coil tubing to engage the coil tubing. The coil tubing is routed by turning the injector device 6 at the desired pressure and speed to transfer the coil tubing to the desired location. Preferably, the pressure exerted by one or more of the plurality of guide means 10 on the coil tubing 23 can be remotely adjusted.

Preferably, the guide means 10 and the means for receiving coil tubing 28 are made from a polymer compound has the ability to withstand temperatures of 422 degrees Fahrenheit, a compressive strength of 13,920 pounds per square inch, a flexural strength of 11,000 pounds per square inch, and a flexural modulus of 350,000 pounds per square inch. The guide means 10 and the means for receiving coil tubing 28 may be made from a member of the group comprising polypropylene, polyurethane, nylon, or mixtures thereof Further, the guide means 10 and the means for receiving coil tubing 28 can be made from a member of the group comprising polyamide or composites of polyamide. In use, polyamide allows for the guide means 10 and the means for receiving coil tubing 28 to be compressible up to four percent and have a coefficient of friction of equal to or greater than 0.03. The coefficient of friction is preferably, in the range of from about 0.03 to about 0.045. These chemical and physical properties provide superior holding capability of the injector device without damaging or flattening the coil tubing 23. Using these types of material also permits the use of coil tubing that has couplings or other downhole tools attached without damaging or flattening the injector or the coil tubing.

Although the present invention has been characterized in terms of the above-described presently preferred embodiment, it will be recognized by those skilled in the art who have the benefit of this disclosure that certain changes and variations may be made to that embodiment without departing from the spirit of the present invention. The present invention is not limited to the above-described presently preferred embodiment, and it is expected that such variations will be encompassed within the scope of the following claims.

What is claimed is:

1. A tubing injector comprising:

a base;

a frame mounted to said base;

an injector device having a longitudinal axis and a perimeter, said injector device being rotatably mounted on said frame;

a plurality of guide means to guide coil tubing along the perimeter of the injector device;

a mounting means connecting said plurality of guide means to said injector device so that said plurality of guide means are movable radially with respect to the longitudinal axis of said injector device from a first position to a second position;

a biasing means that biases said plurality of guide means toward the first position, wherein said biasing means is connected to said mounting means;

a tubing storage having coil tubing stored thereon to be fed onto the injector device;

means for rotating said injector device; and means for straightening said coil tubing;

wherein the injector device further comprises a means for receiving coil tubing forming a groove positioned along the perimeter of the injector device so that the coil tubing is positioned between said plurality of guide means and said groove, said groove having a coefficient of friction of equal to or greater than 0.03;

wherein each of said plurality of guide means comprises a roller having a longitudinal axis and a circumference, wherein said roller forms a groove for engagably receiving tubing along the circumference of the roller;

wherein said roller and said means for receiving coil tubing are made from a polymer compound having the ability to withstand temperatures of 422 degrees Fahrenheit, a compressive strength of 13,920 pounds per square inch, a flexural strength of 11,000 pounds per square inch, and a flexural modulus of 350,000 pounds per square inch.

2. A tubing injector as in claim 1, wherein the roller and said means for receiving coil tubing are made from a member of the group comprising polypropylene, polyurethane, nylon, or mixtures thereof.

3. A tubing injector as in claim 1, wherein said roller and said means for receiving coil tubing are made from a member of the group comprising polyamide or composites of polyamide.

4. A tubing injector as in claim 1, wherein said means for receiving coil tubing is made from steel.

5. A tubing injector comprising:

a base;

a frame mounted to said base;

an injector device having a longitudinal axis and a perimeter, said injector device being rotatably mounted on said frame;

a plurality of guide means to guide coil tubing along the perimeter of the injector device;

a mounting means connecting said plurality of guide means to said injector device so that said plurality of guide means are movable radially with respect to the longitudinal axis of said injector device from a first position to a second position;

a biasing means that biases said plurality of guide means toward the first position, wherein said biasing means is connected to said mounting means;

a tubing storage having coil tubing stored thereon to be fed onto the injector device;

means for rotating said injector device; and means for straightening said coil tubing;

wherein the mounting means comprises a bracket detachably mounted the perimeter of the injector device;

wherein said bracket is attached to said injector device by at least one quick release pin for holding said detachably engaging bracket to said injector device and permitting quick release and pivoting of the hold down means to up to 90 degrees.

6. A tubing injector comprising:

a base;

a frame mounted to said base;

an injector device having a longitudinal axis and a perimeter, said injector device being rotatably mounted on said frame;

a plurality of guide means to guide coil tubing along the perimeter of the injector device;

a mounting means connecting said plurality of guide means to said injector device so that said plurality of guide means are movable radially with respect to the longitudinal axis of said injector device from a first position to a second position;

a biasing means that biases said plurality of guide means toward the first position, wherein said biasing means is connected to said mounting means;

a tubing storage having coil tubing stored thereon to be fed onto the injector device;

means for rotating said injector device; and means for straightening said coil tubing;

wherein the mounting means comprises a bracket detachably mounted the perimeter of the injector device;

wherein said bracket is secured to the injector device with a ¾ inch bolt at a hinge point, three quick release pins for locking the guide means in the closed position on the injector device and one quick release pin point that enables the guide means to be locked in the open position on the injector device.

7. A tubing injector comprising a base;

a frame mounted to said base;

an injector device having a longitudinal axis and a perimeter, said injector device being rotatably mounted on said frame;

a plurality of guide means to guide coil tubing along the perimeter of the injector device;

a mounting means connecting said plurality of guide means to said injector device so that said plurality of guide means are movable radially with respect to the longitudinal axis of said injector device from a first position to a second position;

a biasing means that biases said plurality of guide means toward the first position, wherein said biasing means is connected to said mounting means;

a tubing storage having coil tubing stored thereon to be fed onto the injector device;

means for rotating said injector device; and means for straightening said coil tubing;

wherein the injector device further comprises a means for receiving coil tubing forming a groove positioned along the perimeter of the injector device so that the coil tubing is positioned between said plurality of guide means and said groove, said groove having a coefficient of friction of equal to or greater than 0.03;

wherein said biasing means consists of an actuator means for providing a controlled force normal to the tubing and guide means, wherein said tubing being positively engaged between said groove and said guide means when said injector device is being rotated to pull said tubing off of said tubing storage means or return said tubing to said tubing storage means;

wherein said actuator means comprises a pressure control adjustor; a pressure transmitter connected to said adjustor; a logic circuit for directing the pressure control adjuster; and a pressure sensing means connected to the logic circuit so that pressure on the coil tubing can be adjusted and readjusted in order to provide a constant force against the coil tubing via the guide means.

8. A tubing injector comprising:

a base;

a frame mounted to said base;

an injector device having a longitudinal axis and a perimeter, said injector device being rotatably mounted on said frame;

a plurality of guide means to guide coil tubing along the perimeter of the injector device;

a mounting means connecting said plurality of guide means to said injector device so that said plurality of guide means are movable radially with respect to the longitudinal axis of said injector device from a first position to a second position;

a biasing means that biases said plurality of guide means toward the first position, wherein said biasing means is connected to said mounting means;

a tubing storage having coil tubing stored thereon to be fed onto the injector device;

means for rotating said injector device; and means for straightening said coil tubing;

wherein the injector device further comprises a means for receiving coil tubing forming a groove positioned along the perimeter of the injector device so that the coil tubing is positioned between said plurality of guide means and said groove, said groove having a coefficient of friction of equal to or greater than 0.03;

wherein said biasing means consists of an actuator means for providing a controlled force normal to the tubing and guide means, wherein said tubing being positively engaged between said groove and said guide means when said injector device is being rotated to pull said tubing off of said tubing storage means or return said tubing to said tubing storage means;

wherein said actuator means comprises a pressure control adjustor a pressure transmitter connected to said adjustor; a logic circuit for directing the pressure control adjustor; and a pressure sensing means connected to the logic circuit so that pressure on the coil tubing can be adjusted and readjusted in order to provide a constant force against the coil tubing via the guide means;

wherein the hydraulic actuator has a ¾ inch×2 inch stroke single acting cylinder spring return, with said cylinder mounted on the top of the bracket and an adaptor plug disposed at the end of the shaft mounted through the clevis and the clevis being secured with a locking ring.

9. A tubing injector comprising:

a base;

a frame mounted to said base;

an injector device having a longitudinal axis and a perimeter, said injector device being rotatably mounted on said frame;

a plurality of guide means to guide coil tubing along the perimeter of the injector device;

a mounting means connecting said plurality of guide means to said injector device so that said plurality of guide means are movable radially with respect to the longitudinal axis of said injector device from a first position to a second position;

a biasing means that biases said plurality of guide means toward the first position, wherein said biasing means is connected to said mounting means;

a tubing storage having coil tubing stored thereon to be fed onto the injector device;

means for rotating said injector device; and means for straightening said coil tubing;

wherein the injector device further comprises a means for receiving coil tubing forming a groove positioned along the perimeter of the injector device so that the coil tubing is positioned between said plurality of guide means and said groove, said groove having a coefficient of friction of equal to or greater than 0.03;

wherein said biasing means consists of an actuator means for providing a controlled force normal to the tubing and guide means, wherein said tubing being positively engaged between said groove and said guide means when said injector device is being rotated to pull said tubing off of said tubing storage means or return said tubing to said tubing storage means;

wherein said actuator means further comprises a means for remotely adjusting the pressure exerted on the coil tubing.

10. A method for injecting and retrieving a length of tubing comprising:

utilizing an injector device which can exert pressures of up to 5000 pounds per square inch on coil tubing by;

engaging a section of tubing with the injector device, wherein the injector device has a plurality of guide means disposed thereon; a means for receiving coil tubing; a mounting means connecting the injector device to the guide means so that the guide means is movable radially with respect to the injector device from a first position to a second position; and a biasing means that biases the guide means toward the first position;

adjusting the biasing means to accommodate a section of tubing having protrusions that increase the outer diameter of the tubing, while maintaining a constant force on the tubing normal to the injector device;

exerting varying amounts of pressure on said tubing through at least one of the plurality of guide means in a controlled manner normal to the tubing to engage the tubing;

routing the tubing by turning the injector device at the desired pressure and speed to transfer the coil tubing to the desired location;

wherein the step of engaging a section of tubing includes providing a guide means and a means for receiving coil tubing being made from a polymer compound having the ability to withstand temperatures of 422 degrees Fahrenheit, a compressive strength of 13,920 pounds per square inch, a flexural strength of 11,000 pounds per square inch, and a flexural modulus of 350,000 pounds per square inch.

11. The method of claim 10, wherein the step of engaging a section of tubing includes providing a guide means and a means for receiving coil tubing being made from a member of the group comprising polypropylene, polyurethane, nylon, or mixtures thereof.

12. The method of claim 10, wherein the step of engaging a section of tubing includes providing a guide means and a means for receiving coil tubing being made from a member of the group comprising polyamide or composites of polyamide.

13. The method of claim 10, wherein the step of engaging a section of tubing includes compressing said guide means and said means for receiving coil tubing up to four percent.

14. The method of claim 10, wherein the step of engaging a section of tubing includes providing a guide means having an outer diameter of 5 and ½ inches being capable of extending ¼ inch and retracting ¾ inch.

15. The method of claim 10, wherein the step of engaging a section of tubing includes providing a guide means and a means for receiving coil tubing having a coefficient of friction of equal to or greater than 0.03.

* * * * *